United States Patent [19]

Widemann et al.

[11] Patent Number: 4,944,454

[45] Date of Patent: Jul. 31, 1990

[54] HEATER, IN PARTICULAR VEHICLE AUXILIARY HEATER, WITH A TEMPERATURE SAFETY MECHANISM

[75] Inventors: Friedrich Widemann, Munich; Guenter Kahnau, Soecking; Richard Kohse, Munich; Dieter Raethel, Mittelstetten, all of Fed. Rep. of Germany

[73] Assignee: Webasto AG Fahrzeugtechnik, Fed. Rep. of Germany

[21] Appl. No.: 313,081

[22] Filed: Feb. 22, 1989

[30] Foreign Application Priority Data

Feb. 24, 1988 [DE] Fed. Rep. of Germany ..... 3805610
Nov. 21, 1988 [DE] Fed. Rep. of Germany ..... 3839244

[51] Int. Cl.[5] ..... B60H 1/02
[52] U.S. Cl. ..... 237/12.3 C; 237/2 A
[58] Field of Search ..... 237/12.3 C, 12.3 A, 237/12.3 R, 2 A

[56] References Cited

U.S. PATENT DOCUMENTS 2,192,389 3/1940 Trca ..... 237/12.3 C

FOREIGN PATENT DOCUMENTS 3025283 2/1982 Fed. Rep. of Germany .

*Primary Examiner*—Henry A. Bennett

[57] ABSTRACT

A water type heater, in particular a vehicle auxiliary heater having a temperature safety mechanism, intended to prevent overheating damage to temperature-sensitive parts of the heater, that utilizes a contact sensor that is in heat conducting connection with the heat exchanger. As a heat conducting connection, a direct physical contact between the heat exchanger and a water jacket casing of the heater can be utilized that is, preferably, achieved with the aid of a projection, and optionally, a diametrically opposite projection acting as countersupport. In a modified embodiment, an elastic body that conducts heat well can be placed in a compressed state between the jacket casing and the heat exchanger. The contact sensor then lies against the outer surface of the casing as the temperature safety mechanism. The elastic body that conducts heat well is suitably made in the form of a disk made of a graphite material. In other embodiments, the contact sensor can be spring-mounted or at least a head part thereof can be elastically deformable. In this way, the contact sensor can extend into direct engagement with the heat exchanger without being adversely affected by thermal expansion effects experienced by the heat exchanger and jacket casing during operation of the heater.

23 Claims, 3 Drawing Sheets

HEATER, IN PARTICULAR VEHICLE AUXILIARY HEATER, WITH A TEMPERATURE SAFETY MECHANISM

BACKGROUND OF THE INVENTION

The invention relates to a so-called water heater, in which a liquid heat carrier is present as the heat exchange medium. In particular, the invention is directed to a vehicle auxiliary heater of the type having a burner in a combustion chamber which is surrounded by a heat exchanger which is, in turn, surrounded by a jacket casing to form a jacket space between the heat exchanger and the jacket casing through which the liquid heat exchange medium, such as water, flows, and with a temperature safety mechanism that shuts off the heater to prevent damage to temperature-sensitive parts.

To protect the heat exchanger and other temperature-sensitive parts from damage by overheating which, for example, may occur if the heater is started without liquid heat carrier or if, during operation of the heater, a temperature sensor acting as a control thermostat for regulating the heater operation fails, previously, an immersion type overheating temperature sensor is used in a heater of the type mentioned above that extends through a through-hole in the jacket casing and is suitably fixed in place there. For example, in German Pat. No. 30 25 283, the head of the overheating temperature sensor goes through the jacket space, through which the liquid heat exchange medium flows, and rests on an outer wall surface of the heat exchanger. The outlet of the immersion type sensor is connected to a control device of the heater so that the heater is automatically shut off if the immersion type temperature sensor supplies an output that exceeds a predetermined value. The immersion type sensor must be placed in an especially liquid-tight manner within the bore hole of the jacket casing, for which suitable seals are necessary.

If an immersion type sensor, which acts as a temperature safety mechanism, is to be replaced because, for example, it is defective, or if the heater has been automatically shut off by the temperature safety mechanism with the aid of the immersion type sensor, the immersion type sensor must be taken out of the opening in the jacket casing, so that the fluid-tight sealing of the liquid heat exchanger is broken. During replacement, the liquid circuit of the liquid heat carrier in the heater is thus opened and, for this purpose, it is necessary, if the heater is connected, for example, to the coolant circuit of the motor vehicle, to uncouple the heater from the coolant circuit of the vehicle before the immersion type sensor is taken out. After replacement and installation of a new immersion type sensor, the connection to the coolant circuit of the motor vehicle must, for example, again be made. Thus, the replacement of such an immersion type sensor is expensive, complicated and time-consuming, so that the repair costs needed for this are high.

Furthermore, the known immersion type sensor that contacts the outer wall surface of the heat exchanger is also problematic from the standpoint of reliable operation. That is, by contacting the heat exchanger, a more accurate reading of temperature conditions can be obtained. However, the heat exchanger and surrounding housing jacket will expand and contract to differing extents as a result of the different and varying temperatures to which they are exposed, so that constant contact between the immersion type sensor and the heat exchanger outer wall surface cannot be assured without creating an unacceptable risk of damage due to thermal expansion/contraction effects. Thus, since temperature within the liquid flow-through space of the heater varies with radial distance from the combustion exhaust gas space bounded by the inner surface of the heat exchanger, reliably accurate and sensitive overheat protection cannot be obtained with this known arrangement.

SUMMARY OF THE INVENTION

A primary object of the invention is to provide a heater, in particular a vehicle auxiliary heater, that overcomes the above deficiencies and operates with a liquid heat carrier in which, in a simplified way, an effective protection of the heat exchanger or other temperature-sensitive components, especially in an easy-to-maintain way, is guaranteed.

A specific object of the invention is to provide a water heater wherein the deficiencies of an immersion type overheating sensor can be avoided without losing the sensitivity and accuracy associated with sensing of temperature at the outer wall surface of the heat exchanger of the heater.

A further object of the invention is to enable direct thermal exchange contact to be ensured between an overheating temperature sensor and the outer surface of the heat exchange in a manner which will not be affected by thermal expansion/contraction of the heat exchanger and surrounding jacket casing.

According to a first feature of the invention, a heater, in particular a vehicle auxiliary heater of the type having a burner in a combustion chamber that is surrounded by a heat exchanger which is, in turn, surrounded by a jacket casing to create a jacket space between the heat exchanger and the housing casing through which a liquid heat exchange medium, such as water, flows, and with a temperature safety mechanism that shuts off the heater to prevent overheating damage to temperature-sensitive parts, is provided with a temperature safety mechanism that is in the form of a contact type temperature sensor that is in heat-conducting connection with the heat exchanger, while being disposed exteriorly of the jacket housing.

In particular, preferred embodiments of the heater according to the invention produce a heat-conducting connection from the heat exchanger to a contact temperature sensor so that, in case of replacement of the contact temperature sensor acting as the overheating temperature safety mechanism, the liquid flow circuit of the liquid heat exchange medium through the heater need not be opened. This characteristic considerably facilitates replacement work and allows it to be performed quickly and economically since, during replacement, the heater can remain attached, for example, to the coolant circuit of the motor vehicle. Also, because the liquid flow circuit through the heater is not opened during replacement, seals for installation of the temperature safety mechanism can be eliminated. At the same time, the direct heat-conducting connection of contact temperature sensor and heat exchanger, which affords temperature sensitivity, is retained for detection of an overheating malfunction.

To guarantee a reliable operation of the contact temperature sensor, which acts as a temperature safety mechanism, the contact temperature sensor produces a heat-conducting connection to the heat exchanger near the base of the heat exchanger. Suitably, the contact sensor is placed in the area of the transition from the base to the casing surface of the heat exchanger or slightly separated from it. The base of a heat exchanger, on which the flow direct of hot combustion gases exiting the combustion chamber are reversed by about 180°, represents a temperature-critical area at which, during malfunction, overheating can easily occur that could lead to damaging of the heat exchanger, for example.

According to the invention, the contact temperature sensor can be designed as a thermostat or a thermostatic switch, which depends on the subsequent connection in each case of the contact temperature sensor acting as a temperature safety mechanism.

A preferred embodiment according to the invention is further distinguished in that the heat-conducting connection of contact sensor and heat exchanger is formed by direct contact, at least in the area of the contact sensor, between the heat exchanger and the jacket casing, with which the contact temperature sensor is in direct contact. With this embodiment of the heater, a direct physical contact of contact temperature sensor, housing casing and heat exchanger is present so that a reliable operation of the contact sensor for temperature safety mechanism is guaranteed.

To produce, with this embodiment, a heat-conducting connection of heat exchanger and housing casing with as low a loss as possible, the heat exchanger is force fit in the jacket casing. In a preferred way, a projection is provided on the heat exchanger for creating the direct contact between the jacket casing and the heat exchanger. To avoid an off-center placement of the heat exchanger in the interior of the housing casing, another projection can be placed opposite the first projection, preferably seen in the direction of the diameter of the heat exchanger, so as to act as a countersupport to the first projection. In this way, it is possible to easily achieve a reliable force fit between the jacket casing and the heat exchanger, even at the heater operating temperatures. Preferably, the projection(s) is/are formed on the heat exchanger. Thus the means for producing the force fit between heat exchanger and jacket casing are taken into consideration directly during production of the heat exchanger, which is designed preferably as a cast part.

According to an alternative embodiment of a heater with a contact sensor as a temperature safety mechanism, the heat-conducting connection of contact temperature sensor and heat exchanger is formed by disposing an elastic body that conducts heat well between the heat exchanger and the jacket casing. The elastic body is preferably formed of graphite and is pressed between the heat exchanger and jacket casing to create a direct contact that conducts heat well. With this embodiment, no direct physical connection of jacket casing and heat exchanger is present, but a heat-conducting connection is produced with the aid of the heat conductive elastic body that serves as an intermediate heat conductor.

Here, preferably, the elastic body is disk-shaped and inserted into a recess on the heat exchanger, so that it is fixed to the latter. Because of the elasticity of the heat conductive elastic body, during assembly of the heater, when the housing casing is connected to the heat carrier, the body is compressed so that a reliable contact of the heat conductive elastic body and the heat exchanger, as well as the jacket casing, is achieved. Preferably, the recess in which the elastic body is placed is formed directly on the heat exchanger so that no separate, additional means for holding the heat conductive elastic body on the heat exchanger are needed.

As noted above, thermal expansions and contractions that occur at the heat exchanger and/or the jacket casing, that can vary in extent due to the different and varying high temperatures to which they are exposed, can result in shifting of a contact temperature sensor so that a reliable operation of the contact temperature sensor, for example as a temperature limiter, is no longer guaranteed. To overcome these difficulties, as an alternative to the use of the noted heat conductive elastic body, in accordance with a further development of the invention, the contact temperature sensor, itself, is either formed with an elastically deformable contact head or, according to another preferred embodiment, the contact sensor is spring-mounted. With a spring mounting of the contact sensor, the difficulties in connection with the shifting of the contact temperature sensor, explained above as occurring during operation of the heater, are overcome by a reliable contact being maintained between the contact temperature sensor and the heat exchanger under all operating conditions of the heater.

For spring mounting of the contact temperature sensor, at least one spring can be provided that is designed, advantageously, for example, as a plate spring. This spring lies against the contact sensor on the one hand and, on the other hand, engages a spring retainer which is, preferably, attached to the jacket casing. A flange can be provided as a seat on the contact temperature sensor. The spring retainer is, preferably, attached by a screw connection to the jacket casing, by which the spring tension for the spring mounting of the contact temperature sensor can be varied. To cover the possibility that a shifting of the contact temperature sensor and/or seal leakage may cause some of the liquid heat exchange medium to enter the area around the spring(s), according to another feature of the invention, a drain hole is provided in the jacket casing that produces a connection between the space around the spring(s) and the surroundings. In this way, any liquid heat carrier that may have entered this space can be drained off to guarantee reliable operation of the spring-mounted contact temperature sensor even in this extreme case.

These and further objects, features and advantages of the present invention will become more obvious from the following description when taken in connection with the accompanying drawings which show, for purposes of illustration only, several embodiments in accordance with the present invention.

BRIEF DESCRIPTION OF THE PREFERRED EMBODIMENTS

In the Figures of the drawings, the same or similar parts are provided with the same reference symbols, with prime (') symbols being used to indicate modifications between embodiments.

DETAILED DESCRIPTION OF THE PREFERRED EMBODIMENTS

Figure 1:
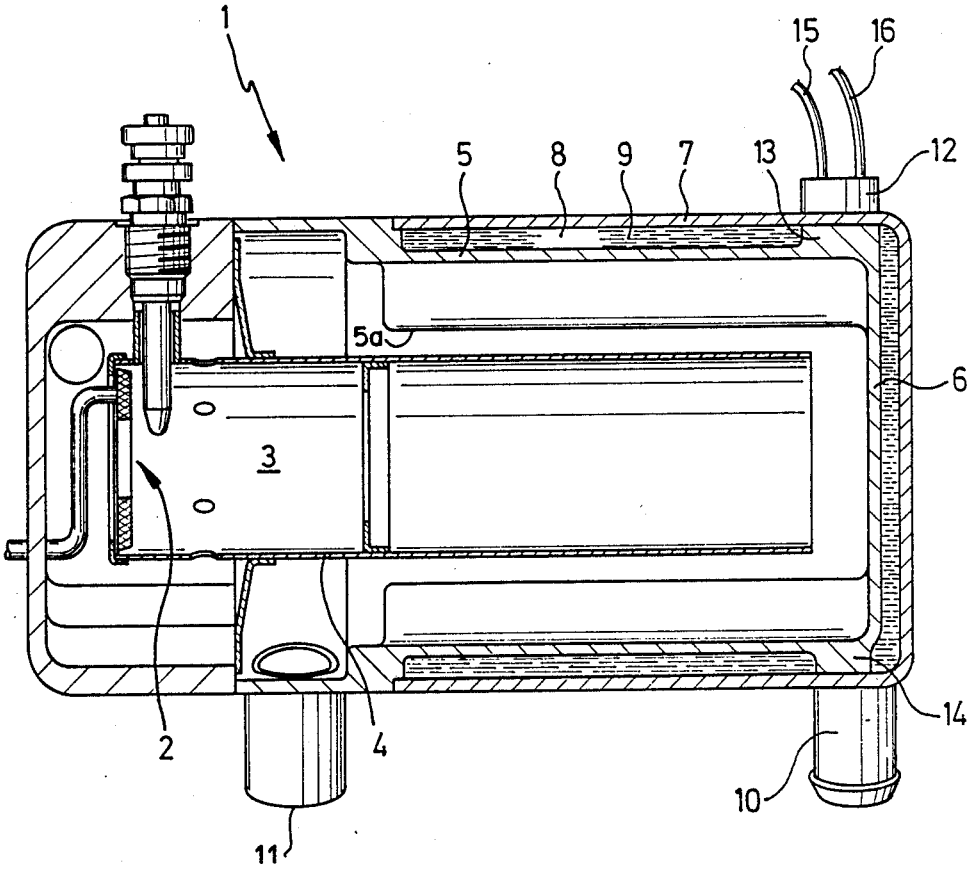
FIG. 1 is a diagrammatic sectionalview of a heater in which a contact type temperature sensor, acting as a temperature safety mechanism, is placed in direct physical contact with the jacket casing, and the jacket casing is in direct physical contact with the heat exchanger.

A heater, in particular a vehicle auxiliary heater liquid heat exchange medium, e.g., a water heater, is shown in FIG. 1 and designated, overall, by reference numeral 1. As essential structural components of such a heater 1, a burner 2 is diagrammatically indicated that projects into a combustion chamber 3, which is formed by a combustion pipe 4. Combustion chamber 3 is coaxially surrounded by a heat exchanger 5, which has a closed end 6 at an end of combustion chamber 3 opposite that at which burner 2 is located. Heat exchanger 5 is surrounded by a jacket casing 7, which forms a so-called water jacket between the outer surface of heat exchanger 5 and its inner surface. The water jacket is in the form of a space 8 through which a liquid heat exchange medium 9 flows. The liquid heat exchange medium 9 is introduced into the jacket space 8 by an inlet 10, and exits the heater 1 via an outlet that is not represented. The hot combustion gases exiting combustion chamber 3 are deflected in the area of the closed end 6 of heat exchanger 5 and pass along the inner surface of heat exchanger 5, which may have inwardly projecting fins 5*a* to facilitate transference of heat from the combustion exhaust gas to the liquid heat exchange medium in space 8. After passing through heat exchanger 5, the combustion gases are exhausted from the heater via an exhaust gas outlet 11.

The numeral 12 designates a diagrammatically depicted contact type temperature sensor that acts as a temperature safety mechanism and is placed directly on the outer surface of jacket casing 7, near the closed end 6 of heat exchanger 5. In the first preferred embodiment of heater 1 according to the invention, represented in FIG. 1, the heat exchanger 5 has a projection 13 in the area in which contact sensor 12 is placed. Projection 13 is, advantageously, formed directly on the body of heat exchanger 5. Another projection 14 acts as a counter-support for projection 13 and engages directly against the inner surface of casing 7 approximately diametrically opposite the first projection 13, relative to heat exchanger 5. In this way, in this embodiment of heater 1, with the aid of projections 13 and 14, a force fit is achieved between jacket casing 7 and heat exchanger 5, so that at least projection 13 is pressed reliably against the inner surface of jacket casing 7 to produce a direct physical contact connection between the casing 7 and the heat exchanger 5, in the area of contact temperature sensor 12, to form a heat-conducting connection.

The electrical connections of contact temperature sensor 12 are represented diagrammatically as lines 15 and 16. The lines 15, 16 lead to a control device (not represented) of heater 1. If the temperature detected by contact temperature sensor 12 exceeds a predetermined value, heater 1 is automatically shut off to prevent overheating or damage to temperature-sensitive parts, in particular heat exchanger 5.

Figure 2:
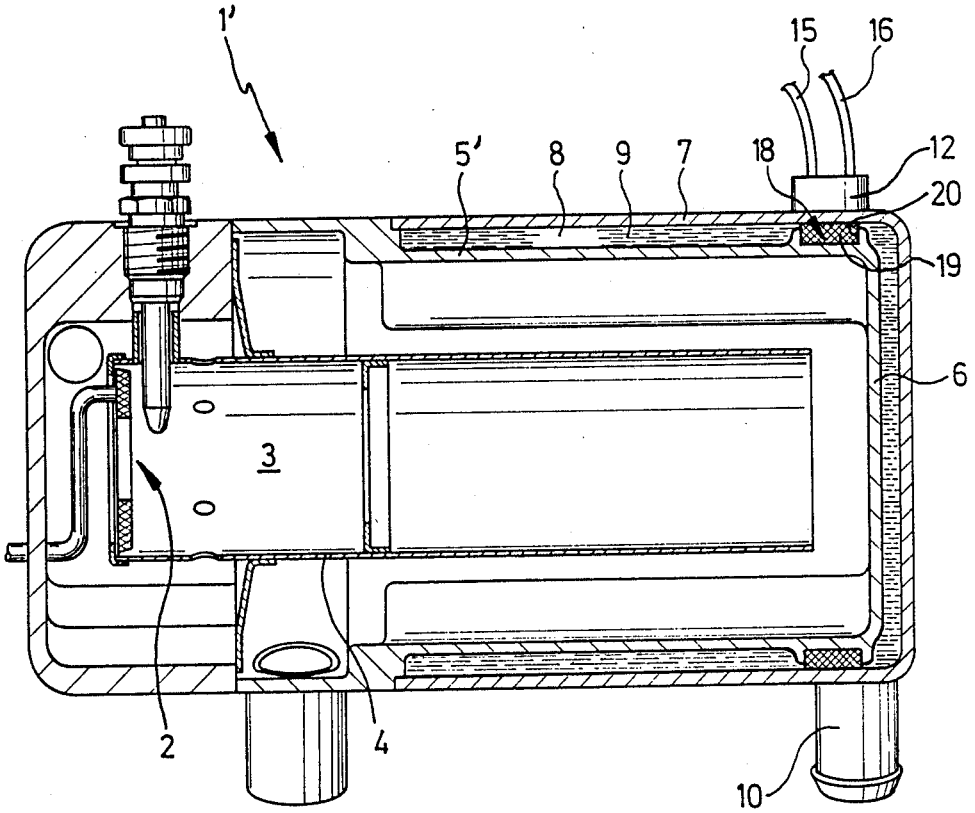
FIG. 2 is a diagrammatic view, similar to that of FIG. 1, but of a modified embodiment of a heater wherein a heat-conducting connection is formed with the aid of an elastic body that conducts heat well.

In FIG. 2, a second preferred embodiment of a heater according to the invention is represented diagrammatically that is designated overall by 1'. Similar to the embodiment of FIG. 1, in heater 1' according to FIG. 2, a burner is also present that projects into a combustion chamber 3. Combustion chamber 3 is surrounded by a heat exchanger 5', which is surrounded, in turn, by casing 7 so that a space 8 is present between casing 7 and heat exchanger 5', through which a liquid heat exchange medium 9 flows. However, this embodiment differs from the embodiment of heater 1 according to FIG. 1, in that heater 1' according to FIG. 2 has a heat-conducting connection formed between the contact temperature sensor 12 and the heat exchanger 5' that is produced by a heat conductive elastic body 18. This body 18 is formed of a material that conducts heat well and can, for example, be in the form of a disk-shaped body of an elastic graphite material. This heat conductive elastic body 18 is placed in a recess 20 formed, preferably directly on the body of heat exchanger 5' of heater 1'. Furthermore, the elastic body 18 is fixed in recess 20 in a manner so as to partially extend therefrom. Thus, during assembly of heat exchanger 5' within jacket casing 7 of heater 1', the portion of elastic body 18 that projects from the recess 20 is elastically compressed in a radial direction and, therefore, reliably engages against the inner wall surface of casing 7, despite varying temperature conditions. Contact type temperature sensor 12 is, then, supported on the outer wall surface of jacket casing 7.

With both of heater embodiments 1 or 1', the contact type temperature sensor 12 can be formed by a thermostat or a thermostatic switch. With the embodiments of heater 1, 1', a contact type temperature sensor 12 is, thus, used as a temperature safety mechanism that is connected in a heat-conducting manner with heat exchanger 5, 5', advantageously near its closed end 6. With both embodiments, a temperature safety mechanism is obtained in the form of contact type temperature sensor 12 which, in case it should require replacement, does not necessitate opening of the flow circuit of liquid heat exchange medium 9 in jacket space 8 of heater 1, 1'. This facilitates the replacement of the temperature safety mechanism in the form of contact type temperature sensor 12, and the work required for this can be performed quickly and economically. For this reason, such a heater 1, 1' has, in particular, an easy to maintain design, and, because of the direct surface contact heat conduction connection present in both embodiments of heater 1, 1', a reliable design is achieved using the contact type temperature sensor 12 as a temperature safety mechanism for detecting if a predetermined critical temperature of the heater 1, 1' is being exceeded.

Figure 3:
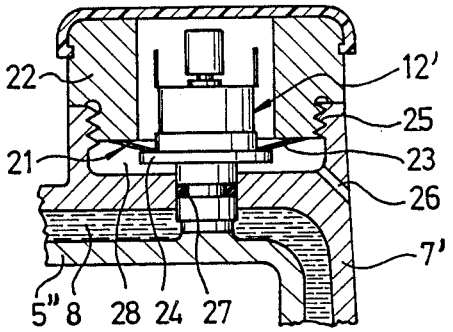
FIG. 3 is a sectional view showing a portion of heater equipped with another embodiment of a contact type sensor in accordance with the present invention.
Figure 4:
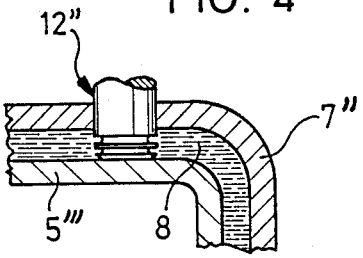
FIG. 4 is a diagrammatic sectional view of a heater illustrating a further embodiment of a contact type sensor.

FIGS. 3 and 4 show a portion of a modified heater embodiment utilizing an immersed contact type temperature sensor designated 12', 12''. The details of heaters 1, 1' that are shown in FIGS. 3 and 4 (which show a part of the heater corresponding to the upper right side of FIGS. 1 and 2) are the same way as in the embodiments explained above.

Contact temperature sensor 12' is spring-mounted in the embodiment shown in FIG. 3. For this purpose, contact sensor 12' has a flange 24 that projects radially. Lying against flange 24 is one end (edge) of a biasing spring 21 which, in this embodiment, is made as a plate or disk spring 23. The other end (edge) of spring 21 or plate spring 23 lies against a spring retainer 22, which is made as a plug-shaped part and is fastened by a screw connection 25 to a sensor receptacle formed on jacket casing 7' of the heater. The arrangement shown in FIG. 3 may use a spacing structure other than plate spring 23 to achieve the function of biasing spring 21. Further, multiple springs 21 can be provided, which depend on the spring tension to be applied by spring(s) 21.

With the contact temperature sensor 12' shown in FIG. 3, the contact sensor is spring-mounted under axially imposed forces so that, even with varying degrees of heat expansion of jacket casing 7 and/or heat exchanger 5'', a heat-conducting connection between heat exchanger 5'' and the end of sensor 12' facing heat exchanger 5'' is always reliably guaranteed. In this way, because the sensor is not rigidly fixed to the heater casing, movements caused by a shifting due to the effects thermal expansion relationships can be evened out thanks to the spring mounting, so that functional disturbances of contact sensor 12' caused by this are avoided.

As shown, contact sensor 12' has a seal 27 that is made, for example, as an O-ring. This seal 27 prevents liquid heat exchange medium in the jacket space 8, between housing jacket 7' and heat exchanger 5', from entering a space 28 that is formed between the spring retainer 22 and the jacket casing 7'. However, if this seal 27 fails, liquid can penetrate into space 28, so that the ability of sensor 12' to function can be interrupted. To prevent such an operational disruption, a drain hole 26 can be provided in the jacket casing, through which liquid penetrating from space 8 can drain out of space 28 into the surroundings. With such a design, a reliable operation of contact sensor 12' is guaranteed, even when seal 27 leaks.

Instead of drain hole 26, a sealing element capable of being dynamically loaded can be provided which, for example, is made of a quadring.

FIG. 4 shows another immersed contact temperature sensor 12'' whose contact part has a head which is in heat-conducting connection with heat exchanger 5''' and is, itself, made of an elastically deformable heat conductive material. With contact temperature sensor 12'', the difficulties associated with the shifting of contact sensor 12'', caused by thermal expansion relationships affecting heat exchanger 5''' and jacket casing 7'' during operation of the heater, can be effectively overcome. The embodiments of FIGS. 3 and 4 are advantageous in that the elastic direct thermal contact relationship between the sensor and heat exchanger provides increased reliability during operation of the heater due to its ability to compensate for the varying thermal effects that affect the jacket casing and the heat exchanger.

Of course, numerous modifications and variations will be recognized by those skilled in the art as being in keeping with the concepts of the present invention. For example, several contact sensors 12, 12', 12'' can be arranged in the same or a similar way at other temperature-critical areas of the heater in case this should be necessary. Thus, the present invention should not be viewed as being limited to the preferred embodiments and modifications thereof disclosed herein, but rather encompasses everything within the scope of the claims appended hereto.

We claim:

1. In a water type heater, for a vehicle auxiliary heater, of the type having a burner in a combustion chamber that is surrounded by a heat exchanger with a closed end facing away from the burner, the heat exchanger, in turn, being surrounded by a jacket casing in a manner creating a jacket space between the heat exchanger and the jacket casing through which a liquid heat exchange medium flows, and with a temperature safety means for shutting off the heater to prevent damage of temperature-sensitive parts, due to overheating; the improvement wherein the temperature safety means is a contact type temperature sensor, and wherein said temperature safety means is provided with means for supporting it exteriorly of the jacket casing and for connecting it in a heat-conducting manner with the heat exchanger.

2. A heater according to claim 1, wherein the heat-conducting connection of the contact type temperature sensor to heat exchanger is located near the closed end of the heat exchanger.

3. Heater according to claim 2, wherein the contact sensor is in the form of one of a thermostat and a thermostatic switch.

4. A heater according to claim 1, wherein the heat-conducting connection between contact type temperature sensor and the heat exchanger is formed by said heat exchanger being in direct contact with the jacket casing, at least in the area of said contact type temperature sensor, and by the temperature sensor being in direct contact with the jacket casing.

5. A heater according to claim 4, wherein the direct contact between the heat exchanger and jacket casing is produced by a force fit.

6. A heater according to claim 5, wherein a contacting projection is provided on the heat exchanger that directly contacts the jacket casing in proximity to the temperature sensor.

7. A heater according to claim 6, wherein a second projection is provided that extends in a diametrically opposite direction from said contacting projection and which lies against the jacket casing as a countersupport for the contacting projection.

8. A heater according to claim 7, wherein the projections are formed as integral parts of the heat exchanger.

9. A heater according to claim 1, wherein the heat-conducting connection between the contact sensor and the heat exchanger is formed via an elastic body, that is formed of a material that conducts heat well, being pressed in between the heat exchanger and the jacket casing at a location at which the contact type temperature sensor is in direct contact with the jacket casing.

10. A heater according to claim 9, wherein the elastic body that conducts heat well is disk-shaped.

11. A heater according to claim 10, wherein the elastic body that conducts heat well is inserted in a recess formed on the heat exchanger.

12. A heater according to claim 11, wherein a second said elastic body is disposed in a second recess that is formed on the heat exchanger at a diametrically opposite side thereof relative to said temperature sensor as a countersupport for the elastic body of the heat-conducting connection.

13. In a water type heater, for a vehicle auxiliary heater, of the type having a burner in a combustion chamber that is surrounded by a heat exchanger with a closed end facing away from the burner, the heat exchanger, in turn, being surrounded by a jacket casing in a manner creating a jacket space between the heat exchanger and the jacket casing through which a liquid heat exchange medium flows, and with a temperature safety means for shutting off the heater to prevent damage of temperature-sensitive parts, due to overheating; the improvement comprising the provision of an elastic means for maintaining a thermal transfer connection between a temperature sensor of the temperature safety means, that is supported on the jacket casing, and an outer surface of the heat exchanger, despite varying thermal expansion effects produced on the heat exchanger and jacket casing during heater operation.

14. A heater according to claim 13, wherein the temperature sensor extends through said jacket space into direct contact with the outer surface of the heat exchanger.

15. A heater according to claim 14, wherein the temperature sensor is provided with an elastically deformable, thermally conductive head portion for contacting the outer surface of the heat exchanger as said elastic means.

16. A heater according to claim 14, wherein the temperature sensor is spring mounted upon said jacket casing as said elastic means.

17. A heater according to claim 16, wherein at least one spring is placed between the temperature sensor and a spring retainer for the spring mounting of the temperature sensor.

18. A heater according to claim 17, wherein said at least one spring is a plate spring.

19. A heater according to claim 18, wherein the plate spring lies against a flange of the temperature sensor.

20. A heater according to claim 19, wherein the spring retainer is fastened to a sensor receptacle formed on the jacket casing.

21. A heater according to claim 20, wherein the spring retainer is fastened by a screw connection to the sensor receptacle of the jacket casing.

22. A heater according to claim 21, wherein a drain hole is provided through the sensor receptacle that connects a space around the spring with the exterior surroundings.

23. A heater according to claim 13, wherein said temperature sensor is a contact type sensor which makes temperature sensing contact with an outer surface of the jacket casing, and a direct thermal transfer connection is formed between the jacket casing and the outer surface of the heat exchanger in the area of said sensor by an elastic body of a material that conducts heat well being compressed between the outer surface of the heat exchanger and the jacket casing.

* * * * *